US005232217A

United States Patent [19]

Cota et al.

[11] Patent Number: 5,232,217

[45] Date of Patent: Aug. 3, 1993

[54] TRIPLE-PLAY GAME

[76] Inventors: Albert O. Cota, 17475 Flanders St., Granada Hills, Calif. 91344; David K. Legatzke, 7601 Encino Ave., Northridge, Calif. 91325

[21] Appl. No.: 806,621

[22] Filed: Dec. 13, 1991

[51] Int. Cl.[5] ..... A63B 63/08; A63B 67/10; A63B 43/00; F41J 3/00

[52] U.S. Cl. ..... 273/1.5 A; 273/58 C; 273/346; 273/413; 273/414

[58] Field of Search ..... 273/1.5 R, 1.5 A, 346, 273/345, DIG. 17–DIG. 19, DIG. 30, 58 C, 58 J, 58 A, 331, 65 EE, 414, 413, 26 E

[56] References Cited

U.S. PATENT DOCUMENTS

| | | | |
|---|---|---|---|
| 667,563 | 2/1901 | Oakley | 273/26 E |
| 795,960 | 8/1905 | Cook | 273/58 C |
| 2,562,089 | 7/1951 | Fishlove | 273/345 |
| 2,928,677 | 3/1960 | McAdam | 273/345 |
| 3,032,345 | 5/1962 | Lemelson | 273/346 |
| 3,288,466 | 11/1966 | Cumings | 273/331 X |
| 3,602,504 | 8/1971 | Chapman | 273/331 X |
| 3,613,294 | 10/1971 | Graham | 273/DIG. 17 X |
| 3,940,129 | 2/1976 | Franco | 273/DIG. 17 X |
| 3,940,133 | 2/1976 | Civita | 273/58 C |
| 4,036,494 | 7/1977 | Hayes | 273/1.5 R |
| 4,454,253 | 6/1984 | Murphy et al. | 273/58 J X |
| 4,522,394 | 6/1985 | Broussard | 273/1.5 R |
| 4,863,176 | 9/1989 | Lapkewych | 273/346 |
| 4,940,232 | 7/1990 | Chen | 273/1.5 A X |
| 5,014,983 | 5/1991 | Saunders | 273/1.5 R |

FOREIGN PATENT DOCUMENTS

| | | | |
|---|---|---|---|
| 2125758 | 12/1972 | Fed. Rep. of Germany | 273/65 EE |

OTHER PUBLICATIONS

The Sporting Goods Dealer, Oct. 1973 p. 41 Cosom Ad, Model 777 Urethane Foam Football.

Sports Illustrated, Jan. 7, 1980, p. 4, Nerf Basketball.

Indian Head Recreation Products Catalog #971, Feb. 1972. Passback.

Korney Board Aids, Basketball Coaching and Training Aids 1989 School Mail Order Catalog, p. 45 Poof Basketball, Dec. 1988.

*Primary Examiner*—Paul E. Shapiro

*Attorney, Agent, or Firm*—Albert O. Cota

[57] ABSTRACT

A triple-play game (10) that allows three games to be played indoors: basketball, tetherball and target-board. All three games utilize a pole (12) positioned vertically between the ceiling and floor of a room. Basketball is played with a ball (20) attached to a line (14) having its other end attached to a wrist strap (24). The basketball backboard (30) is clipped to the pole (12) and has a ball-hoop (34) having a frontal narrow opening (38). When the ball is tossed through the ball-hoop, the attached line follows and falls through the opening (38). Whether a player makes a basket or misses, all that is necessary to retrieve the ball (20) is to pull the line (14). Thus, the player can remain at the original shooting position. The tetherball game features a safety pole-clip (50) designed to slip down the pole (12) if a force of over five pounds is applied. Therefore, if the line becomes entangled around a child's neck, the line will come down avoiding harm. The target-board game also has a clip-on target-board (60) having a VELCRO® target-face (62). A safe projectile (70) having a VELCRO front section (74) is used to toss at the target-face (62).

13 Claims, 3 Drawing Sheets

TRIPLE-PLAY GAME

TECHNICAL FIELD

The invention pertains to the general field of indoor games and more particularly to a game structure that allows the ball of a basketball game to be easily and quickly retrieved without moving from the original ball tossing position and that allows conversion to the games of tetherball and target-board.

BACKGROUND ART

Indoor games have become increasingly popular over the years and more so in areas where inclement weather is prevalent. Individual indoor games such as basketball and dart games have been available for many years. However, a triple-play game in which a single structure, such as a pole, can serve to accommodate the games of basketball, tetherball and a target/projectile game have not been available. An indoor tetherball game has particularly been missing from the marketplace. The reason for this absence has been the possibility that the line used with the game can be easily entangled around a child's neck and cause a severe injury. This problem has been solved by the instant invention.

The indoor basketball games currently available require that after tossing the ball, whether or not the basket is made, the player or someone else must retrieve the ball before the next shot is taken. This problem is especially a nuisance if a solitary basketball game is being played. Again, the instant invention solves this problem by utilizing a split ball-hoop in combination with a tethered ball that is easily retrieved after the shot is taken.

A search of the prior art did not disclose any patents or marketing literature that read directly on the claims of the instant invention.

DISCLOSURE OF THE INVENTION

The triple-play game is designed to be primarily used indoors for playing either the game of basketball, tetherball or target-board. The common element used with all three games is a dismantable, sectioned pole that is designed to be vertically placed between the ceiling and floor of a room. The pole includes an upper or lower spring-loaded assembly that allows the pole to self-adjust to most ceiling heights. Alternatively, a weighted base may be used to hold the pole in a vertical position. The weighted base allows the triple-play game to also be played outdoors.

The basketball and tetherball games utilize a foam or air filled ball that is attached to a light but strong line. When playing basketball, the end opposite the ball is attached to a wrist strap. The basketball game includes a backboard that has a pair of spring clips that allow the board to be clipped to the pole at a player selected height and any lateral angle. To the front of the backboard is attached a ball-hoop that has a frontal narrow opening. When the tethered ball is tossed into the basket the attached line follows and subsequently slips through the narrow opening and falls to the ground. Whether the player makes a basket or misses, the ball can be quickly and easily retrieved by pulling on the line attached to the ball and the player's wrist. Thus, the ball shooter can remain at the original shooting position without having to move to retrieve the ball. The ball retrieval problem is particularly a nuisance if the basketball game is being played by a single person.

The tetherball game is played by attaching the line with the ball to a safety pole-clip, once attached one or two players can play. One reason that indoor tetherball has not been popular is that if the line becomes entangled around a child's neck, a severe neck injury is possible. To prevent such an accident, the tetherball game of the instant invention uses the safety pole-clip that is designed to slip down the pole when a sustained downward weight of five pounds (2.27 Kg) is placed on the line. Therefore, if the line should become entangled around a child's neck, the weight of the child will cause the clip with the line to come down and avoid a possible serious accident.

The third game available with the triple-play game is the target-board game that consists of a target-board and a target projectile. The target-board has attached to its backside a pair of spring clips that allow the board to be clipped to the pole at a player selected height and lateral angle. The frontside of the target-board has a VELCRO® surface that allows various complimentary VELCRO surfaced target-faces to be attached. The target-face can vary from the conventional circular rings to a face. The target projectile is made of a soft element that has stabilizing fins at the rear and a complimentary VELCRO front section. The front section allows the tossed projectile to stick to the target-face when the game is being played.

In view of the above disclosure, it is the primary object of the invention to provide a safe triple-play indoor game that features a basketball game having a split ball-hoop. In addition to the primary object, it is also an object of the invention to provide a triple-play game that:

- is safe for players of all ages,
- is primarily designed for indoor use but that can also be played outdoors,
- allows easy conversion from one game to the other,
- can be played by one or more players,
- requires no maintenance with the exception of an occasional replacement of the line, and
- is cost-effective from both a manufacturer and consumer point of view.

BEST MODE FOR CARRYING OUT THE INVENTION

Figure 1:
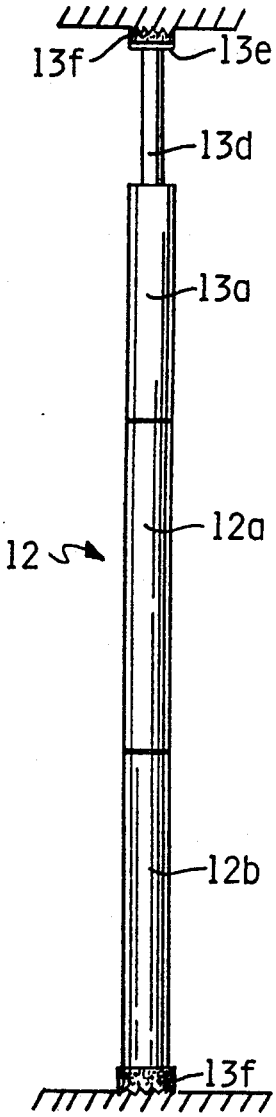
FIG. 1 is an elevational view of a fully assembled pole as used with the triple-play game.

The best mode for carrying out the triple-play game is presented in terms of a preferred embodiment that consists of a single structure that allows three games to be played: a basketball game, a tetherball game or a target-board game.

The preferred embodiment, as shown in FIGS. 1 through 12 is comprised of the following major elements: a pole 12, a line 14 attached on one end to a ball 20 and on the other end to a wrist strap 24, a basketball backboard 30, a ball hoop 34 having a frontal narrow opening 38, a safety pole-clip 50, a target board 60 and a target projectile 70.

The common element used in all three games is the pole 12. In the United States and in most other countries, the floor to ceiling heights ranges from 7 feet (213 cm) to 10 feet (305 cm) with the most common height being 8 feet (244 cm). To accommodate these heights, the pole 12 as shown in FIG. 1 is provided with a means for adjusting the length of the pole and to place the pole in a substantially vertical position.

The preferred means for providing the adjustable pole length is by having a pole 12 as shown in FIG. 1, that consists of a plurality of insertable sections. These sections which are constructed of aluminum or plastic can be made in various lengths and diameters to accommodate a specific height and required structural integrity. For the most common height of eight feet, either three or four sections may be used with three sections preferred as follows: a spring-loaded assembly 13 which preferably comprises the top section of the pole 12 but that can also comprise the pole's bottom section. Attached to the assembly 13 as shown in FIG. 1, is a first section 12*a* followed by a second section 12*b* where each of these sections has a length of three feet (91 cm). The assembly 13 provides an outward force against the ceiling or floor that maintains the pole 12 in a stable vertical position when the pole is placed between a lower and upper surface as shown in FIG. 1.

Figure 2:
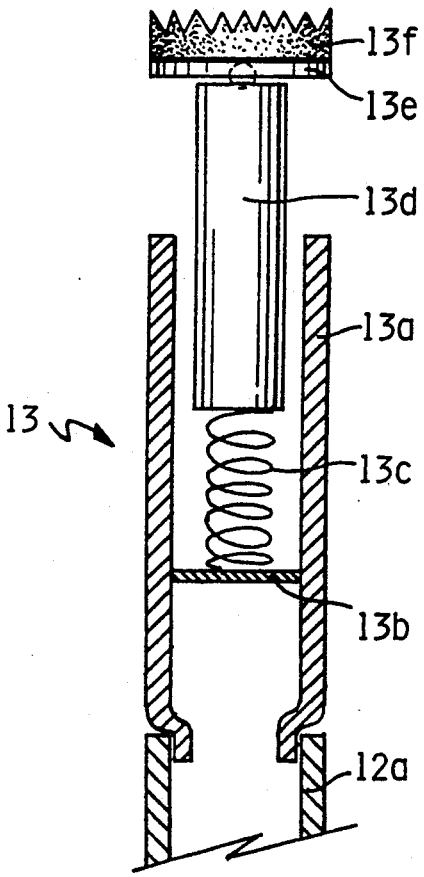
FIG. 2 is a sectional view of the spring-loaded assembly that comprises a section of the pole as shown in FIG. 1.

As shown in FIG. 2, the assembly 13 consists of a 20 inch (50.8 cm) section 13*a* having an integral stop 13*b* that functions to stop a spring 13*c* that is inserted into the open end of section 13*a*. Interfacing with the spring is a movable rod 13*d* that has an articulated pad 13*e* that further includes a resilient surface gripping cap 13*f*. A cap 13*f* is also placed over the end of the second section 12*b*. The assembly provides a variable stable length between 7 feet 9 inches (236 cm) and 8 feet 3 inches (252 cm) which is sufficient to accommodate the majority of floor to ceiling heights.

Figure 3:
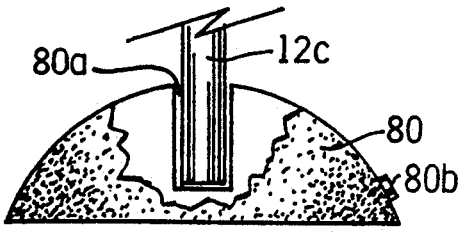
FIG. 3 is a partial sectional view of a weighted base that is used to hold the bottom end of the pole.

As an alternative for placing the pole 12 in a substantially vertical position, a weighted base 80 may be employed as shown in FIG. 3. In this scheme, the spring-loaded assembly 13 is not used. The weighted base has a molted pole bore 80*a* into which is inserted the bottom section of a third pole section 12*c*. The weighted base 80 may be constructed of a solid material such as concrete or it may be hollow with a closable opening 80*b* that allows the base to be filled with water or sand. With the weighted base, the triple-play game can be used both indoors and outdoors thus, increasing the utility of the invention.

Figure 4:
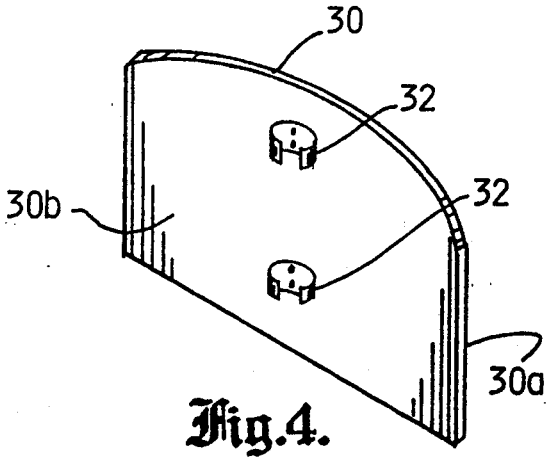
FIG. 4 is a perspective view of the backside of the basketball backboard showing the placement of two spring clips.
Figure 5:
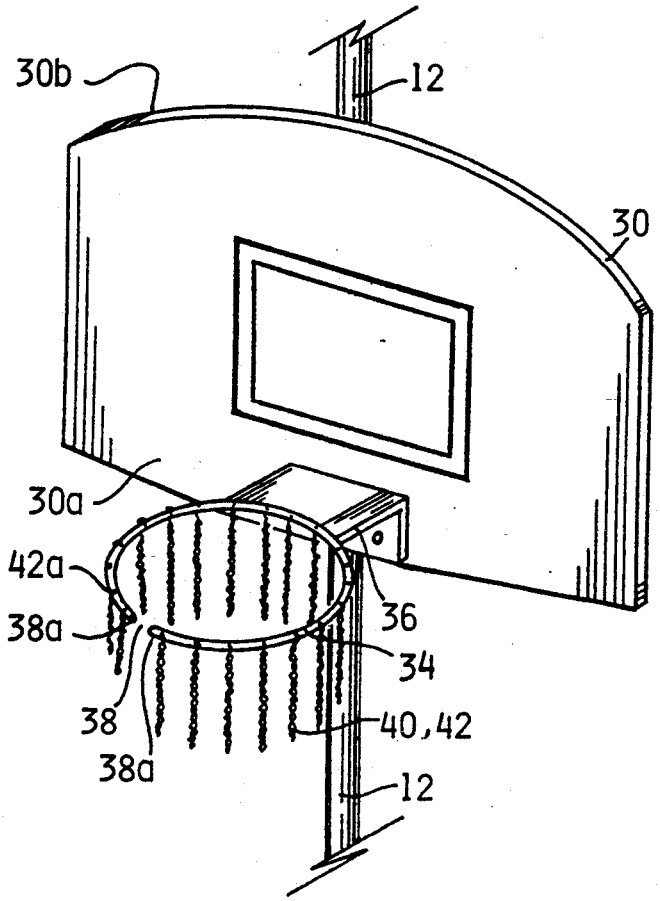
FIG. 5 is a perspective view of the frontside of the basketball backboard showing the placement of the ball-hoop with a frontal narrow opening.

The first triple-play game described is the basketball game which is played by providing a basketball backboard 30 that has attached to its backside 30*b* at least one vertically oriented spring clip 32 as shown in FIG. 4. The clips allow the backboard to be clipped onto the pole 12 at any player selectable height and lateral angle as shown in FIG. 5. On the front surface 30*a* of the backboard 30 is located the ball-hoop 34 as also shown in FIG. 5. The ball-hoop includes a bracket 36 that attached to the front surface 30*a* of the backboard by conventional means.

The ball-hoop features a frontal opening 38 that is less than 0.5 inches (1.27 cm) with an opening of 0.25 inches (0.636 cm) preferred. The two terminating ends 38*a* of the opening 38 are beveled to eliminate any jagged edges and to provide a smooth passage of the line 14 through the opening as described infra. The ball-hoop also includes a split net 40 (not shown) that is attached around the partial circumference of the ball-hoop by an attachment means. The split is in alignment with the frontal narrow opening 38 on the ball-hoop. Alternatively, as shown in FIG. 5, the net 40 may consist of a multiplicity of individual strands 42. Each strand has a hook 42*a* that is inserted into a respective multiplicity of hoop bores 44 that are drilled around the partial circumference of the ball-hoop.

Figure 6:
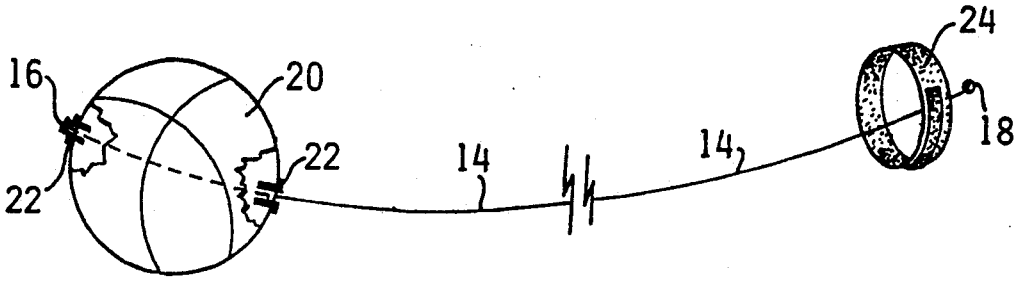
FIG. 6 is a perspective view of the line attached on one end to a ball and on the other end to a wrist strap.

To play the basketball game a strong, light line 14 having a length between 10 and 25 feet (305 to 762 cm) is used. As shown in FIG. 6, one end of the line is attached to a ball 20 and the other end to an elastized band (not shown) or a wrist strap 24 consisting of a narrow strap that is held on the wrist by a combination hook and loop fastener-sold under the trademark VELCRO.

The ball 20 is preferably constructed of a high-density polyurathane foam however, an air inflatable ball will also function adequately. If a foam ball is used, as shown in FIG. 6, a plastic sleeve 22 is inserted on each opposite side of the ball and the line is passed through the sleeves 22. The sleeves prevent the line from cutting into the foam. A flat end cap 16 is then attached to the line 14 protruding through the ball to hold the line in place. The other end of the line 14 is attached to the wrist strap 24. The line can be permanently attached to the wrist strap or wrist band or as shown in FIG. 6, the wrist strap 24 is wrapped around the wrist with the line extending over the edge of the wrist band. To maintain the line on the wrist a round end cap 18 as also shown in FIG. 6, is attached to the line to keep the line captive. To function properly, the line 14 must be strong and sufficiently light so that it does not interfere with the forward travel of the ball 20 when the ball is tossed.

To play the basketball game, a player tosses the tethered ball 20 through the ball-hoop 34. Since the ball is attached to the line 14, the ball falling through the ball hoop is followed by the line that in turn, falls through the narrow opening 38 on the ball-hoop 34. Thus, after the player "shoots" the ball, the ball can be retrieved by the player without moving from the initial shooting position by merely pulling on the line 14 attached to the ball 20.

Figure 7:
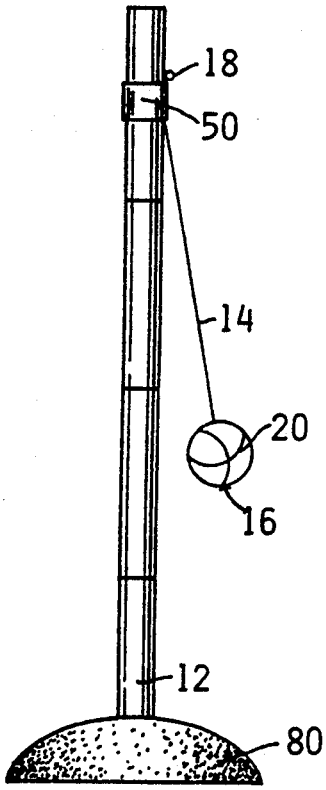
FIG. 7 is an elevational view of the tetherball game with the pole inserted into a weighted base.
Figure 8:
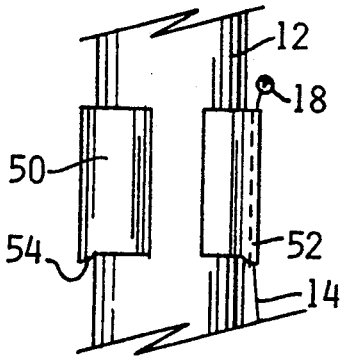
FIG. 8 is a side view of the safety pole-clip with the line attached.

The second game available for use with the triple-play game 10 is the tetherball game as shown in FIG. 7. The primary reason for the unavailability of an indoor tetherball game has been the fear that small children could have their necks entangled in the line causing a neck injury or worse, being asphyxiated by the entangled line. The inventive tetherball game features a safety pole-clip 50 that greatly diminishes the possibility that such an accident can occur. The pole clip 50 as best shown in FIG. 8, is designed to be frictionally held around the circumference of the pole 12 at a player selected height. The clip is further designed to slip downwardly on the pole 12, when a downward weight in excess of 5 lbs (2.27 Kg) is placed on the line. Thus, a line entangled around a child's neck will quickly loosen to prevent an accident.

The pole-clip has an outward bevel 54 on its lower circumferential edge that prevents the pole-clip 50 from being held-up by the interfacing pole seams or other pole obstructions. Also, the pole-clip as shown by the dotted lines in FIG. 8, includes an internal vertical groove 52 into which is placed the line 14 with the line's round end cap 18 extending over the edge of the clip. With the line so attached, the ball 20 will wrap around the ball when struck by one or alternatively by two players to thus, allow the game of tetherball to be played.

Figure 9:
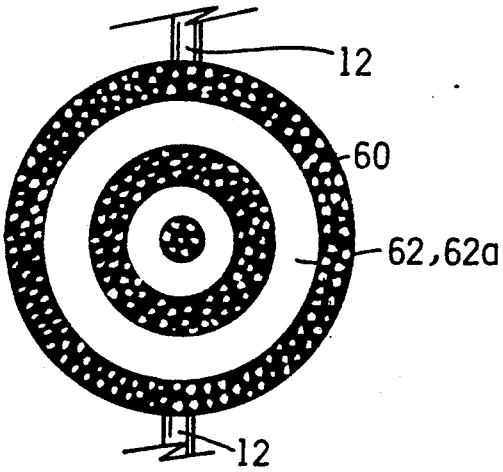
FIG. 9 is a front view of the target-board attached to the pole.
Figure 10:
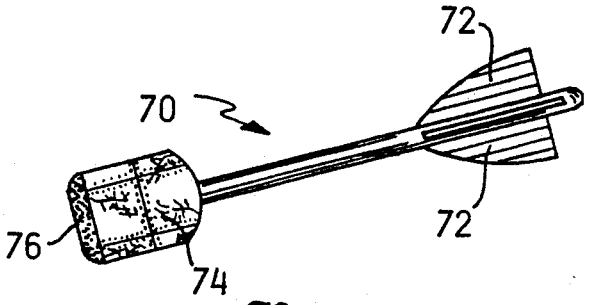
FIG. 10 is a side view of the target projectile used with the target-board game.

The final triple-play game is a target-board game that consists of a flat target board 60 and a target projectile 70 as shown in FIGS. 9 and 10. To play the target-board game, the basketball backboard 30 may remain on or be removed form the pole 12.

Figure 11:
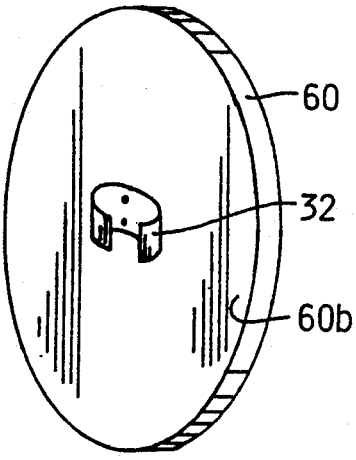
FIG. 11 is a perspective view of the backside of the target-board showing the placement of two spring clips.
Figure 12:
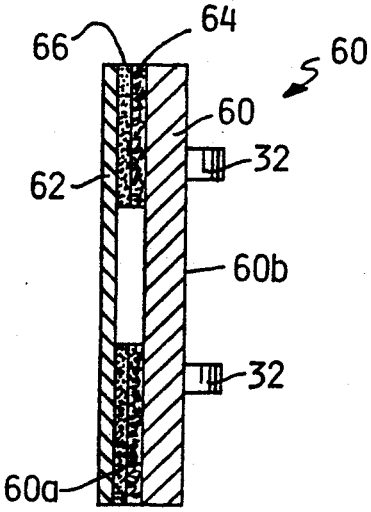
FIG. 12 is a side sectional view of the target-board.

The target-board 60 has attached to its backside **60*b* at least one vertically oriented spring clip 32 as shown in a FIG. 11. The clips allow the target-board to be clipped onto the pole 12 at a player selectable height. As shown in FIG. 12, the target-board 60 is a composite structure consisting of a removable target-face 62 sized to substantially cover the front surface 60*a* of the target board. The front of the target-face consists of a hook surface sold under the trademark VELCRO that is embellished with a target face (not shown) or a bulls eye target as shown in FIG. 9**.

The target-face 62 may be attached to the target-board 60 by various means. However, preferably as shown in FIG. 12, the attachment is made by a combination hook 64 and loop 66 fasteners respectfully attached to the front surface **60*a* of the target-board 60 and to the back surface of the target-face 62**.

The target-board game is played with a soft, front-weighted target projectile 70 as shown in FIG. 10. The projectile has on its back section a plurality of stabilizing fins 72 and a front section 74 having a front loop surface 76 compatible with the hook surface **62*a*** on the target-face. In lieu of the above described projectile a small, soft ball covered in a VELCRO loop surface may also be used to throw at the target-face. When the projectile is aimed and thrown by a player at the target-board, the projectile sticks to the surface of the target-face to thus allow a safe target-board game to be played.

While the invention has been described in complete detail and pictorially shown in the accompanying drawings it is not to be limited to such details, since many changes and modifications may be made to the invention without departing from the spirit and the scope thereof. For example, a light fixture can be easily attached to the spring-loaded assembly 13 or to any other insertable section. The light fixture would have its electrical wiring slipped downwardly through the pole 12 onto an opening at a bottom section from where the wiring would be extracted and plugged into an electrical outlet. Hence, it is described to cover any and all modifications and forms which may come within the language and scope of the claims.

We claim:

1. A triple-play game comprising:

a) a pole having means for adjusting its length and for placing said pole in a substantially vertical position, b) a ball attached to a line with said line having a round end cap on the end opposite the ball attachment end, c) a basketball game comprising:

(1) a backboard having attached to its backside at least one vertically oriented spring clip that allows said backboard to be clipped onto said pole at a player selectable height, (2) a ball-hoop having a frontal, narrow opening and a back section that is attached to the front surface of said backboard, (3) a wrist strap placed around a player's wrist over said line with the line's round end cap extending over the edge of said wrist strap, whereupon when a player tosses the tethered ball through said ball-hoop, said ball is followed by the attached said line that in turn, falls through the narrow opening on said ball-hoop, thus allowing the player to retrieve said ball by pulling on said line attached to said ball, d) a tetherball game comprising:

a safety pole-clip sized to be frictionally held around the circumference of said pole at a player selected height and lateral angle, said pole-clip having an internal vertical groove into which is placed said line with the line's round end cap extending over the edge of said pole-clip to allow said line attached to said ball to wrap around said pole when struck by one or two players to thus, allow the game of tetherball to be played, where said pole-clip is designed to slip downwardly on the pole, when a downward weight in excess of 5 lbs (2.27 kg) is placed on said line and with said pole-clip having an outward bevel on its lower circumferential edge that prevents said pole-clip from being held-up by adjoining pole seams or other pole obstructions, e) a target-board game comprising:

(1) a flat target-board having attached to its backside at least one vertically oriented spring clip that allows said target-board to be clipped onto said pole at a player selectable height, (2) a removable target-face sized to substantially cover the front surface of said target-board, where the front of said target-face consists of a hook surface embellished with a target, and (3) a soft, front-weighted target projectile having on its back section a plurality of stabilizing fins and a front section having a loop surface compatible with the hook surface on said target-face, whereupon when said projectile is aimed and thrown by a player at said target-board, the projectile sticks to the surface of said target-face to allow a safe target-board game to be played.

2. The triple-play game as specified in claim 1 wherein said means for adjusting the length of said pole and placing said pole in a substantially vertical position is accomplished by said pole consisting of a plurality of insertable sections, where either the top or bottom section is spring loaded to apply an outward force so that when said pole is placed between a lower and an upper surface, the spring force maintains said pole in a stable vertical position.

3. The game as specified in claim 1 wherein said means for placing said pole in a substantially vertical position is accomplished by inserting the bottom of said pole into a weighted base having a pole bore therein sized to accept said pole.

4. The game as specified in claim 1 wherein the top and bottom ends of said pole have a resilient gripping cap.

5. The game as specified in claim 1 wherein said ball is made of a high-density polyurathane foam.

6. The game as specified in claim 1 wherein said line is sufficiently light to not interfere with the forward travel of said ball when said ball is tossed when playing the basketball game.

7. The game as specified in claim 1 wherein said frontal narrow opening on said ball hoop is less than 0.5 inches (1.27 cm).

8. The game as specified in claim 1 wherein said wrist strap consists of a narrow strap held on the wrist by a combination hook and loop fastener.

9. The game as specified in claim 1 wherein said wrist strap consists of an elastized band that is placed over the hand onto the wrist.

10. The game as specified in claim 1 further comprising a split net that is attached around the partial circumference of said ball-hoop by an attachment means, where the split is in alignment with said frontal narrow opening on said ball-hoop.

11. The game as specified in claim 10 wherein said net consists of a multiplicity of individual strands where each strand has a hook that is inserted into a respective multiplicity of hoop bores drilled around the circumference of said ball-hoop.

12. The game as specified in claim 1 wherein said target-face is attached to said target board by a combination hook and loop fastener respectfully attached to the front surface of said target board and to the back surface of said target-face.

13. A basket-ball game comprising:

a) a backboard vertically attached to a structure by an attaching means.

b) a ball-hoop having a frontal, narrow opening and a back section that is attached to the front surface of said backboard.

c) a net consisting of a multiplicity of individual strands where each strand has a hook that is inserted into a respective multiplicity of hoop bores drilled around the circumference of said ball-hoop, d) a ball sized to easily fall through said ball-hoop, e) a wrist strap placed around a player's wrist, and f) a line having one end attached to said ball and the other end attached to said wrist strap, whereupon when a player tosses said ball through said ball-hoop, said ball is followed by the attached said line that in turn, falls through the narrow opening on said ball-hoop thus, allowing the player to remain at his ball throwing position and retrieve said ball by pulling on said line attached to said ball and said wrist strap.

* * * * *